US011098559B2

(12) United States Patent
Ivanov et al.

(10) Patent No.: US 11,098,559 B2
(45) Date of Patent: Aug. 24, 2021

(54) CASING REAMER SHOE

(71) Applicant: OOO "AGD", Moscow (RU)

(72) Inventors: Andrey A. Ivanov, Moscow (RU); Aleksey V. Sidorenko, Moscow (RU); Dmitriy A. Priymachenko, Moscow (RU); Gurban Gulam ogly Veliev, Moscow (RU)

(73) Assignee: OOO "AGD", Moscow (RU)

( * ) Notice: Subject to any disclaimer, the term of this patent is extended or adjusted under 35 U.S.C. 154(b) by 0 days.

(21) Appl. No.: 17/185,907

(22) Filed: Feb. 25, 2021

(65) Prior Publication Data

US 2021/0180433 A1 Jun. 17, 2021

Related U.S. Application Data

(63) Continuation of application No. PCT/RU2019/000587, filed on Aug. 21, 2019.

(30) Foreign Application Priority Data

Aug. 28, 2018 (RU) ..... 2018131001

(51) Int. Cl.
*E21B 37/00* (2006.01)
*E21B 17/14* (2006.01)

(52) U.S. Cl.
CPC ..... *E21B 37/00* (2013.01); *E21B 17/14* (2013.01)

(58) Field of Classification Search
CPC ..... E21B 37/00; E21B 17/14; E21B 37/02; E21B 37/04; E21B 37/045; E21B 37/08; E21B 17/07; E21B 17/073; E21B 17/076
See application file for complete search history.

(56) References Cited

U.S. PATENT DOCUMENTS 3,405,771 A 10/1968 Carr et al.
4,298,978 A 11/1981 Nakamura
(Continued)

FOREIGN PATENT DOCUMENTS

RU 97764 U1 9/2010
RU 2513788 C1 4/2014
(Continued)

OTHER PUBLICATIONS

International Search Report from International Application No. PCT/RU2019/000587, dated Aug. 21, 2019, dated Jan. 23, 2020.

*Primary Examiner* — David Carroll
(74) *Attorney, Agent, or Firm* — Patentbar International, P.C.

(57) ABSTRACT

The device is designed for borehole reaming during casing—casing reamer shoes mounted in the conductor guide hole of a string or liner. The casing reamer shoe has a sub connected via a sleeve with a spiral mandrel having at least one screw groove, and a mandrel with a drill shoe located at one end thereof, and a pipe with at least one pin at the other end. The mandrel is mounted movably on the spiral mandrel inside a case being rigidly connected to the sub. The pin is arranged in the groove. The cross section of the screw groove has a shape of a trapezoid expanding in the direction of the longitudinal axis of the shoe. The pin has a stepped cylindrical shape with a conical transition. The device increases reliability and lifetime of the casing reamer shoe due to the shape of the grooves and pins.

2 Claims, 3 Drawing Sheets

(56) References Cited

U.S. PATENT DOCUMENTS

| | | | | |
|---|---|---|---|---|
| 8,191,655 | B2 | 6/2012 | Declute-Melancon | |
| 8,973,682 | B2 | 3/2015 | Gosselin | |
| 2011/0139510 | A1* | 6/2011 | Declute-Melancon | E21B 10/26 175/53 |
| 2016/0237764 | A1 | 8/2016 | Jellison et al. | |

FOREIGN PATENT DOCUMENTS

| | | | |
|---|---|---|---|
| RU | 162846 | U1 | 6/2016 |
| RU | 2634676 | C1 | 11/2017 |

* cited by examiner

CASING REAMER SHOE

RELATED APPLICATIONS

This application is a Continuation Application of International Application PCT/RU2019/000587, filed on Aug. 21, 2019, which in turn claims priority to Russian Patent Application RU2018131001, filed Aug. 28, 2018, both of which are incorporated herein by reference in their entirety.

FIELD OF THE INVENTION

The invention relates to devices designed for borehole reaming during casing, more particularly to casing reamer shoes mounted in the conductor guide hole of a string or liner.

BACKGROUND OF THE INVENTION

Known is a device for uphole extension without rotation of casing string, that includes a mandrel connected with downhole end of casing column. The mandrel has at least one groove in side wall. Sleeve is movably connected with mandrel. Bow is connected with downhole end of the sleeve. At least one pin is associated with the sleeve having at least one groove, such that longitudinal movement of mandrel relating to sleeve causes rotation of sleeve relating to the mandrel, thus rotating the bow (under U.S. Pat. No. 8,191,655, cl. E21B 10/44, publ. May 6, 2012).

The drawback of such construction is the availability of a spring that complicates assembling of the device and makes transportation of a device difficult, when expanded.

Known is a device for cleaning of a hole connected with flow column and containing sleeve with pins which is rotating in response to axial reciprocating movement of flow columns due to spiral device with grooves, which contains pins inside. Liquid is drilled through a device for raising pollutions to the surface through the circular space (U.S. Pat. No. 8,973,682, cl. E21B 21/00, E21B 37/00, E21B 17/07, publ. Oct. 3, 2015).

The drawback of this system is wearing upon operations, namely, upon friction of bronze pins in grooves of spiral device made from aluminium. As a result of wearing, the steel sleeve arrives into contact with the spiral device that decreases the reliability and resource of the instrument.

SUMMARY OF THE INVENTION

The technical result achieved by the proposed invention is the increased reliability and lifetime of the casing reamer shoe due to the shape of the grooves and pins.

The said technical result is achieved by the following. The casing reamer shoe proposed includes a sub connected by means of a sleeve with a spiral mandrel having at least one screw groove, and a mandrel with a drill shoe located at one end thereof, and a pipe with at least one pin at the other end thereof, the mandrel is mounted movably on the spiral mandrel inside a case which is rigidly connected to the sub, the pin is arranged in the groove, wherein the cross section of the screw groove has a shape of a trapezoid which expands in the direction of the longitudinal axis of the shoe, and the pin has a stepped cylindrical shape with a conical transition.

Moreover, the bottom of the groove may have the arc-shape.

BRIEF DESCRIPTION OF THE DRAWINGS

The present invention is shown on the following drawings.

DETAILED DESCRIPTION OF THE PREFERRED EMBODIMENTS

Figure 1:
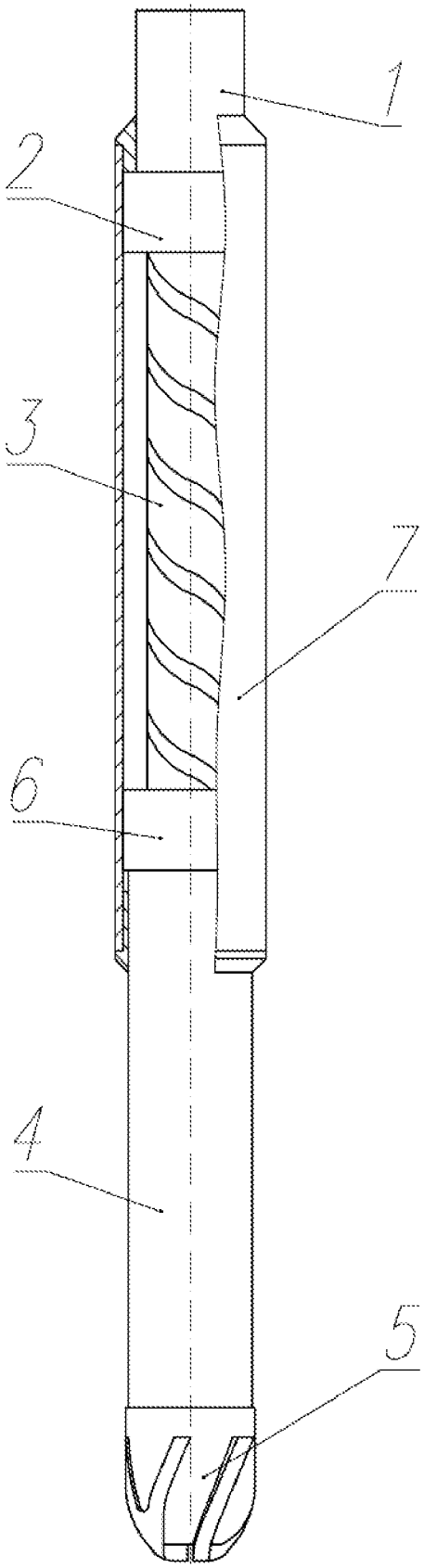
FIG. 1 shows the casing reamer shoe, mandrel is in extracted position.

The casing reamer shoe (FIG. 1) includes the sub 1 connected by means of the sleeve 2 with spiral mandrel 3, and the mandrel 4 with the drill shoe 5 located at one end thereof and the pipe 6 at another end. The sub is rigidly connected to the case 7.

Figure 2:
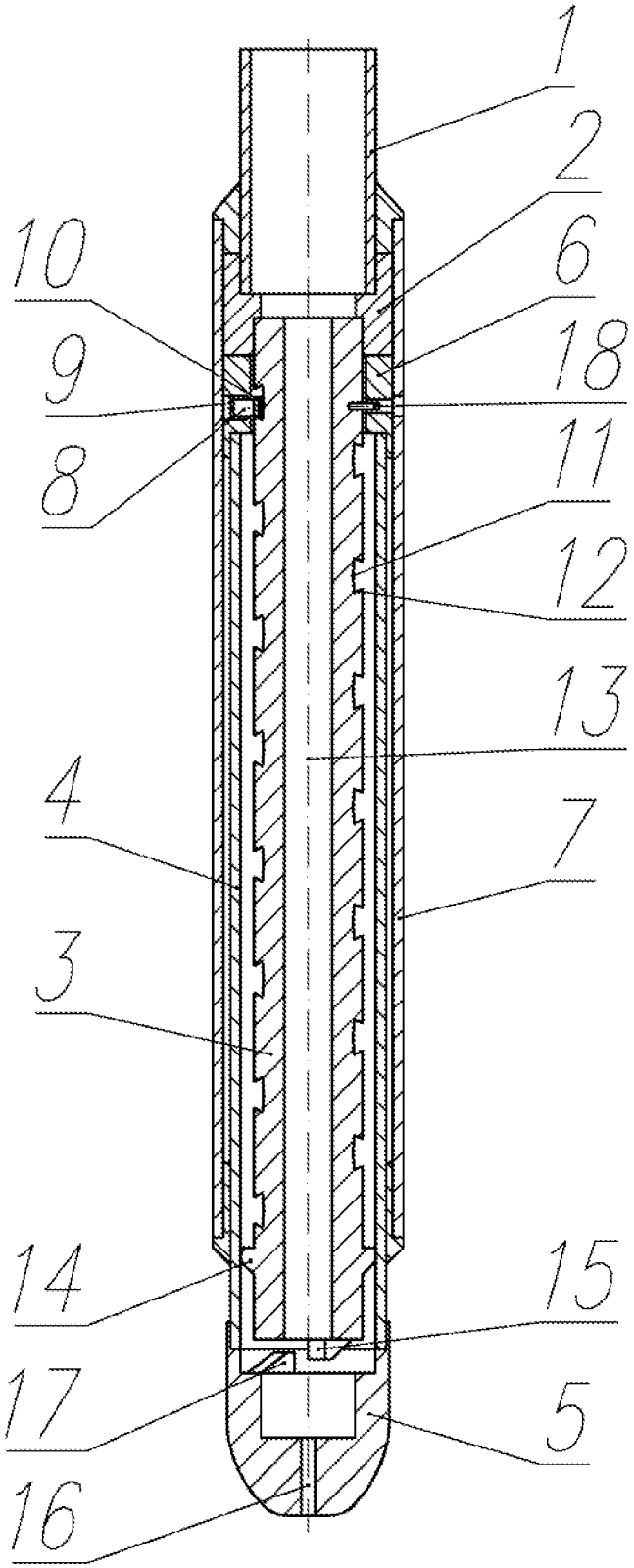
FIG. 2 shows the casing reamer shoe, mandrel is inserted, longitudinal section.
Figure 3:
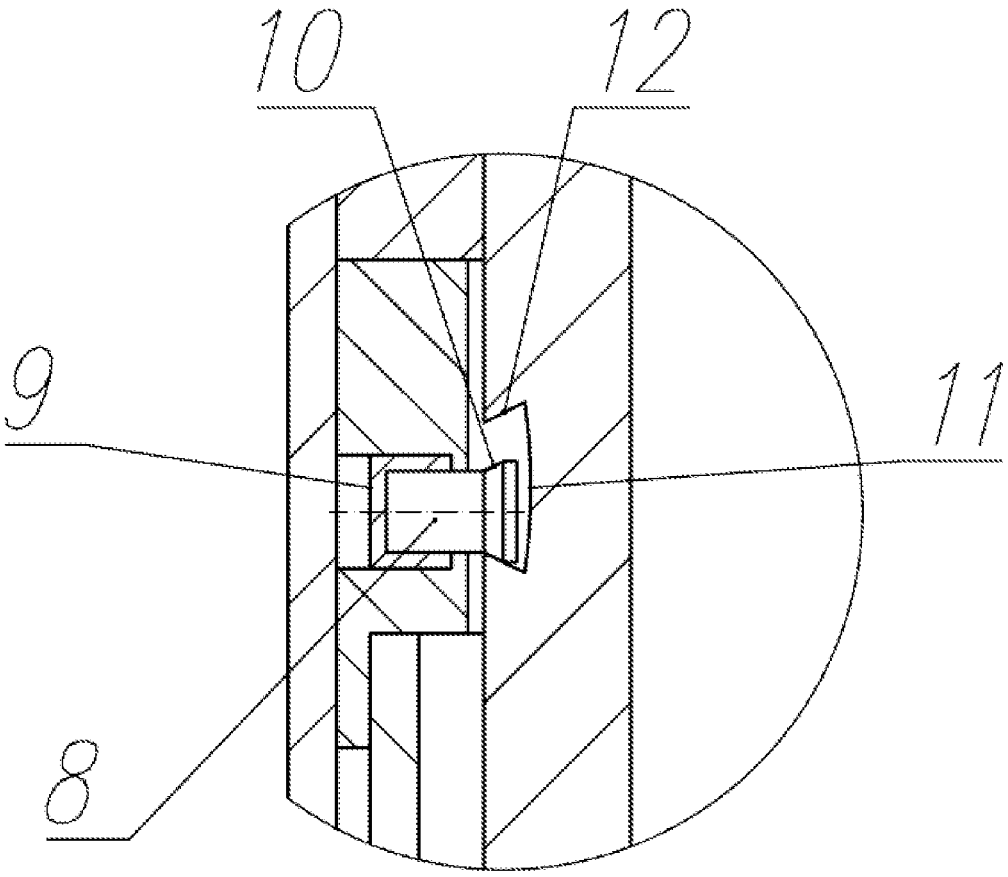
FIG. 3 shows the pin and the groove.

Pin 8 is mounted within pipe 6 (FIG. 2), overhang of which is regulated by to a clamp 9. Pin 8 has the stepped cylindrical shape with a conical transition 10. Pin 8 is arranged in the screw groove 11, which has a shape of a trapezoid in cross-section and expands in the direction of the longitudinal axis. Pin 8 moves on inclined screw surface 12 of groove 11.

Spiral mandrel 3 has the longitudinal opening 13, the centralizer 14 and the support 15 at lower butt end.

The openings 16 and support 17 are made in the drill shoe.

Screw 18 has been used for fixation of mandrel 4 relating to spiral mandrel 3 upon transportation.

The casing reamer shoe operates in the following mode.

The casing reamer shoe is arranged in the lower part of casing column (not shown). Before mounting it is necessary to unscrew screw 18 for securing movability.

Upon running into the well, reciprocating movements of the column are transformed into the rotating movement of mandrel 4 with drill shoe 5 due to movement of pins 8 in screw grooves 11. As a result, drill shoe 5 restores open hole from different types of problems such as slime formations, caving grounds, shoulders, rock swelling etc.

In the process of bleeding from the surface the liquid has been provided, going through internal cavity of the sub 1, openings 13 and 16. As soon as casing column reaches planned depth, cementing procedure has been arranged, after which the casing reamer shoe is drilled out.

As the contact of pin 8 and groove 11 is arranged by conical transition 10 and inclined screw surface 12 respectively, pipe 6 is centralized with respect to spiral mandrel 3, that prevents friction. Friction is highly undesirable, as pipe 6 is normally made from steel, while spiral mandrel 3 is made of aluminum alloy, and in case of friction the spiral mandrel 3 will tore and will be out of service quickly.

Therefore, the provided solutions provides the achievement of the technical result, namely, reliability and lifetime of the casing reamer are increased.

What is claimed is:

1. A casing reamer shoe comprising:

a sub connected by means of a sleeve with a spiral mandrel, the spiral mandrel having at least one screw groove;

a mandrel being movably mounted on the spiral mandrel inside a case, the case being rigidly connected to the sub, the mandrel comprising a drill shoe located at one end of the mandrel and a pipe located at the other end of the mandrel;

the pipe having at least one pin arranged in the at least one screw groove, the at least one screw groove having a cross section of a shape of a trapezoid expanding in a direction of a longitudinal axis of the casing reamer shoe; and the at least one pin having a stepped cylindrical shape with a conical transition.

2. The casing reamer shoe according to claim 1, wherein a bottom of the at least one screw groove is arc-shaped.

* * * * *